US005289702A

United States Patent [19]

Murray

[11] Patent Number: 5,289,702

[45] Date of Patent: Mar. 1, 1994

[54] LOAD BALANCE INDICATOR FOR TOP LOADING AUTOMATIC CLOTHES WASHING MACHINES

[76] Inventor: Joseph A. Murray, 116 Smoke Rise Dr., Warren, N.J. 07059-6821

[21] Appl. No.: 1,560

[22] Filed: Jan. 6, 1993

[51] Int. Cl.[5] ..... D06F 39/00

[52] U.S. Cl. ..... 68/23 R; 68/12.27; 68/212; 116/281; 210/91

[58] Field of Search ..... 68/3 R, 12.27, 13 R, 68/23 R, 212, 235 R; 116/200, 281, 282, 283; 210/91

[56] References Cited

U.S. PATENT DOCUMENTS 2,068,495 1/1937 Lamb ..... 210/91

*Primary Examiner*—Philip R. Coe

*Attorney, Agent, or Firm*—Robert A. Green

[57] ABSTRACT

The disclosure is of washing machine apparatus including a ring, within the clothes basket, and imbalance indicators coupled thereto and adapted to provide a visual indication to an operator when an imbalance occurs and provides problems in the spin cycles. The indicators show the operator where the imbalance is located and it can be easily corrected.

9 Claims, 4 Drawing Sheets

LOAD BALANCE INDICATOR FOR TOP LOADING AUTOMATIC CLOTHES WASHING MACHINES

BACKGROUND OF THE INVENTION

A typical top loading automatic clothes washing machine operation will generally consist of the following cycles, when operating in the normal wash function:

1. Fill with Water
2. Wash and Agitate
3. Drain the Water
4. Spin and Drain
5. Fill with Water
6. Rinse and Agitate
7. Drain the Water
8. Spin dry and Drain There may also be an optional second rinse involved, which would require a repeat of cycles 5 through 8.

Many of the top loading automatic clothes washing machines that are manufactured today for household use are of large or very large capacity, because they are being loaded with a wide variety of items to be washed. These items are made of fabrics containing wool, cotton, polyesters, nylon, other synthetic fabrics and/or combinations thereof. These items range from the very light and delicate (underclothing, etc.) to the most heavy and rugged (jackets, jeans, blankets, bedspreads, mattress covers, towels, etc.). Each of the above fabrics retains water at different rates after the water has been pumped out of the tub at the end of the wash and rinse cycles.

This could present a problem in the spin cycles, even if a conscientious effort has been made to balance the load by placing similar items opposite each other in the tub. The purpose of the agitator during the wash and rinse cycles is, to keep all the items constantly moving and tumbling, so that they can be washed or rinsed properly. Therefore at the end of the wash or rinse cycles all of the items might be mixed. Because of this, there is a good possibility that the load will be unbalanced at the start of the spin or spin-dry cycles, which follow. A minimal imbalance will have no adverse effect, but if the imbalance is sufficient, the basket will wobble, causing the washing machine to make some noise and possibly start banging and move across the floor, and it may even shut itself down automatically. When this happens the washing machine has to be turned off manually and the items in the tub will have to be rearranged. This is all guess work.

The platform of the automatic washing machine (FIG. 1) contains the main working parts of the machine such as the tub, basket, agitator, water pump, transmission, electrical motor, clutch assembly, etc., and is suspended by suspension legs from the top of the side frames of the machine.

When the washing machine has a perfectly balanced load and it is in the spin or spin-dry cycle, the center of the agitator top (FIGS. 1, 3 and 4) is the pivot point for the agitator and basket, and this point will remain fixed or stationary, while the agitator and basket are spinning. When the load is unbalanced, this pivot point will not remain fixed or stationary, but will move around in its own circle. (This will give the impression that the agitator and basket are wobbling, because of their spinning speed). The amount of imbalance will determine the radius of the circle. If the weight of the imbalance is sufficient, it will cause the washing machine platform (FIG. 1) to move around in its own circle and possible to come in contact with the insides of the washing machine frame, resulting in a banging noise and the possibility of the machine moving across the floor.

If the top lid were to be opened while the washing machine is running during one of the spin cycles, whether there is an unbalanced load or not, the safety lid switch would open an electrical circuit, causing the spinning action and possible wobbling movement of the agitator and basket, to slow down and come quickly to a complete stop. When opening the top lid, when the load is unbalanced, the agitator and basket can be observed to be spinning and wobbling at their maximum speed, and rapidly decreasing to a complete stop. Since the speed and movement are directly proportional to each other, e.g.: maximum speed equals maximum wobbling movement, minimal speed equals minimum wobbling movement, it would be very hard to judge with certainty where the unbalanced part of the load is located, because, when the spinning is reduced to a speed, where you can track the items inside the basket, the wobbling has also been reduced to a point where there is hardly any movement. Therefore, there may not be any visible indication of the cause of the imbalance.

The rearranging of the items may have to be performed several times during the spin and/or spin-dry cycles. Trying to guess how to balance the load, can be very irritating and annoying, and if the users suffer from impaired vision or a complete loss of sight, they may not be able to correct this imbalance themselves and they will have to wait until someone can assist them. Also, it is not good for the life of the electrical motor to be turned on and off repeatedly.

SUMMARY OF THE INVENTION

The present invention provides apparatus in a top loading automatic clothes washing machine for permitting an operator to determine the location of an imbalance in the load, which may cause the washing machine to malfunction. The invention includes a solution to this problem by providing means inside the washing machine which respond to improper rotation of the clothes basket during the spin/spin-dry cycles, and provide an indication to the operator where the load is unbalanced. The operator can then rearrange the clothes and permit the washing operation to proceed properly.

Many patents deal with the problem of load imbalance in top loading automatic clothes washing machines, but they only provide apparatus to shut down the machine by cutting off power, when a significant imbalance occurs. However, none provides information about the imbalance itself, so that it can be easily corrected, particularly by a visually handicapped person.

DESCRIPTION OF THE INVENTION

Figure 1:
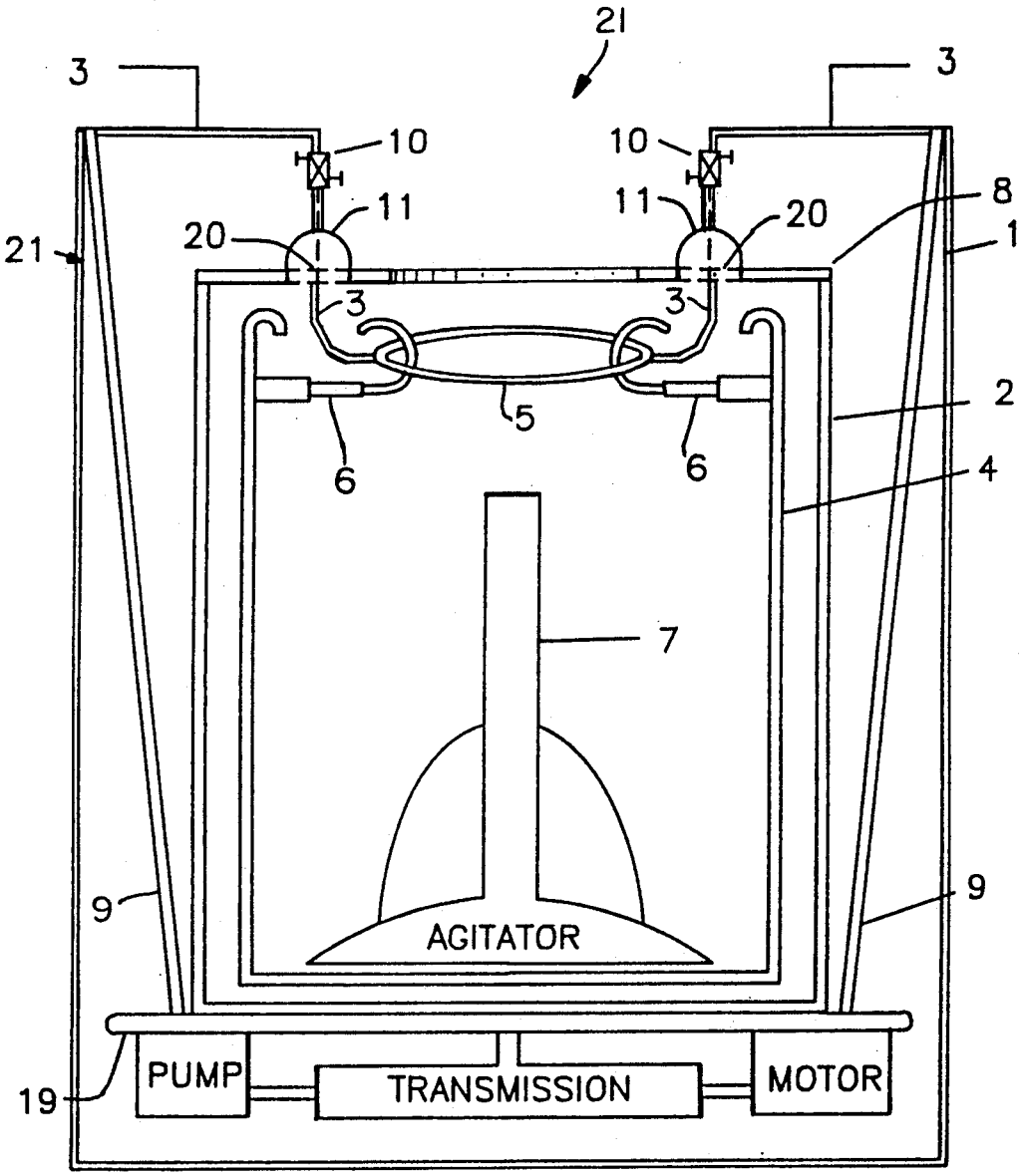
FIG. 1 is a front view, partly in section, of a closed washing machine embodying the invention.

A top loading automatic clothes washing machine 21 embodying the invention includes an outer frame 1, an inner tub 2, and within the tub 2, an inner basket 4, which receives clothes to be washed. Within the basket 4 is the agitator 7, which keeps all of the items constantly moving and tumbling during the wash and rinse cycles. The tub 2 is secured to a lower horizontal platform 19, which contains the main working parts of the machine such as a waterpump, a transmission-motor assembly, a clutch assembly, and other apparatus as required. The platform 19 is suspended by a plurality of suspension legs 9 from the top of the side frames of the machine frame 1.

Figure 2:
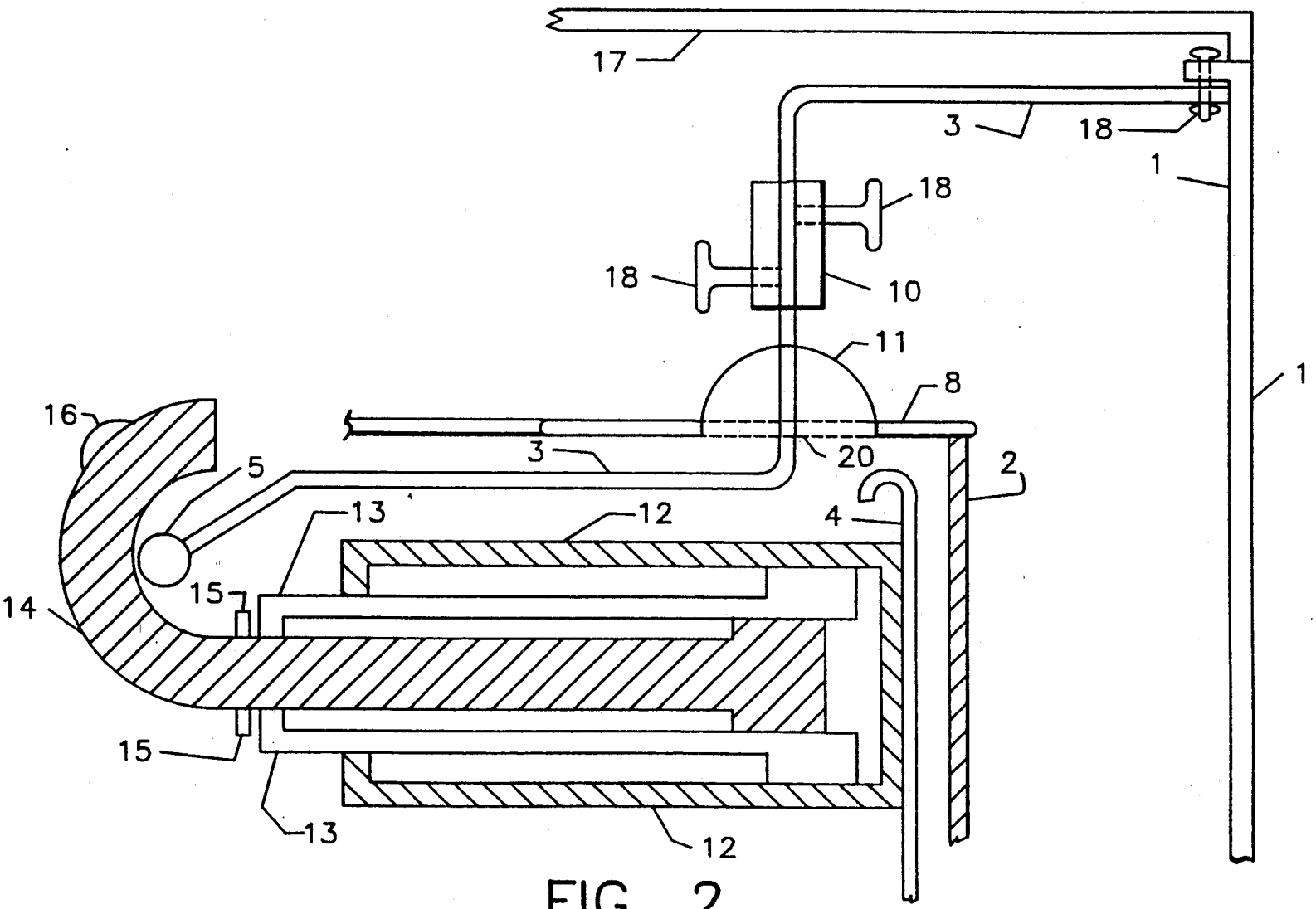
FIG. 2 is a side sectional view of a portion of the apparatus of FIG. 1.
Figure 3:
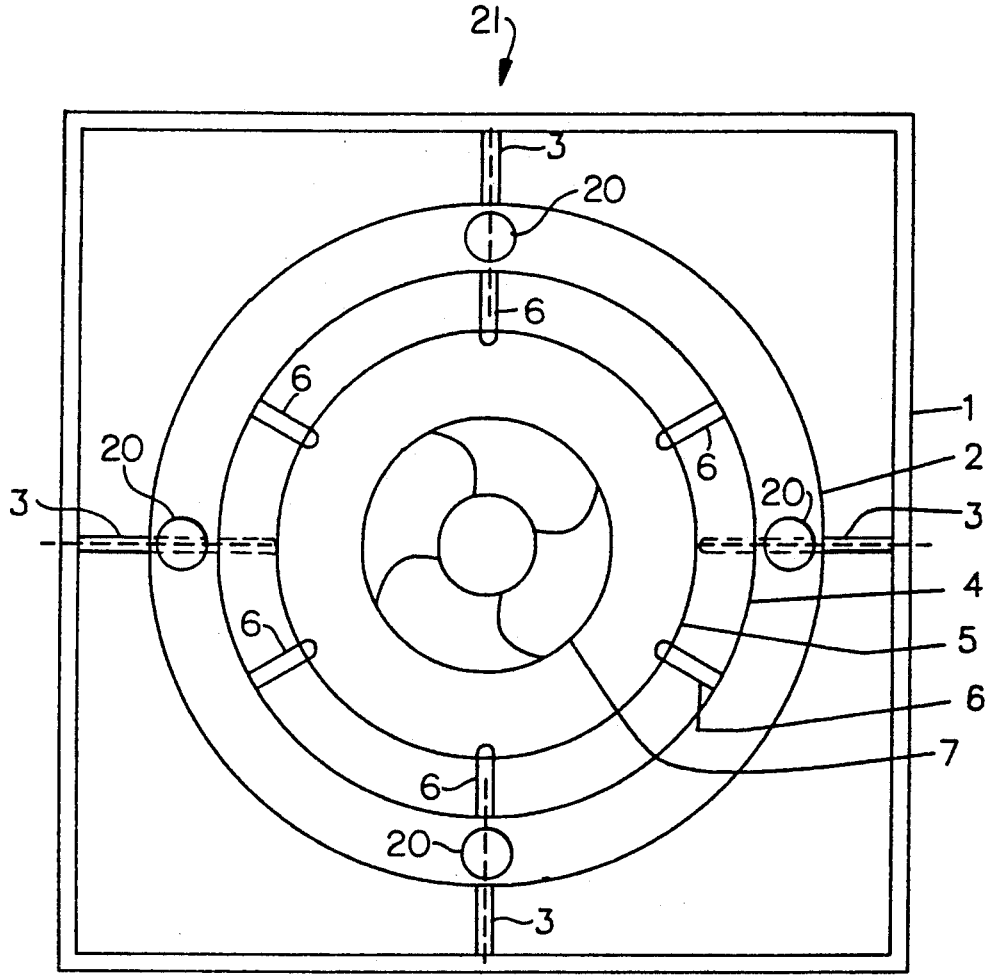
FIG. 3 is a top view of a portion of the apparatus of FIG. 1.
Figure 4:
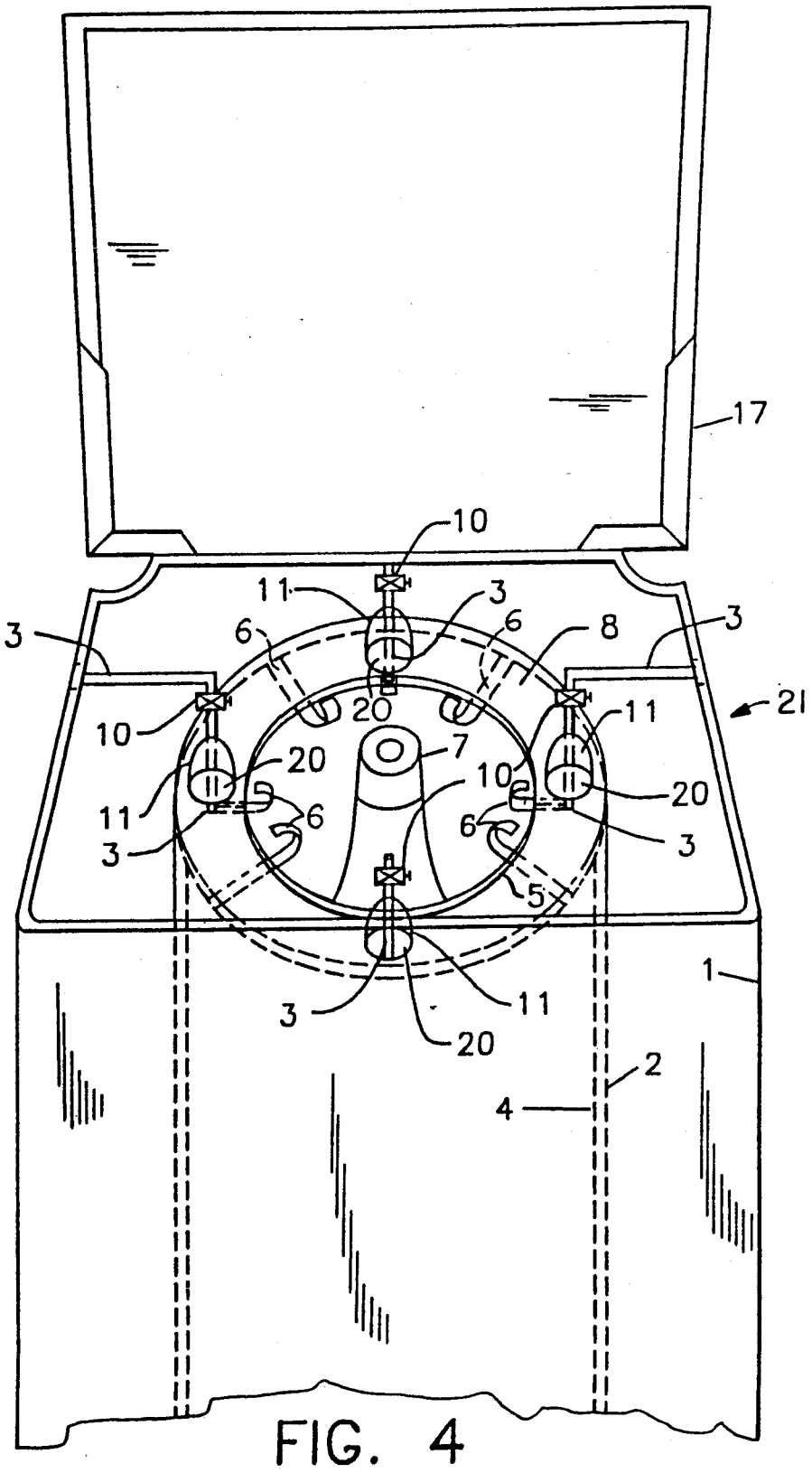
FIG. 4 is a perspective view of the invention.

According to the invention, means are provided which operate when an unbalanced load causes wobbling of the clothes basket 4 and agitator 7, and which provide an indication of the location of the imbalance to the operator. These means include a FIXED GUIDE RING 5, which is positioned just underneath the frame top 17 and tub cover 8. The diameter of the FIXED GUIDE RING 5 is equal to the diameter of the circular top lid opening of the tub 2. The FIXED GUIDE RING 5 is held in a fixed position and is secured to the top center of the four side frames of the cabinet 1, by means of four rod-like GUIDE RING SUPPORTS 3, 90 degrees apart. Each GUIDE RING SUPPORT 3 is fastened on one side to the FIXED GUIDE RING 5, extending laterally from the circumference of the FIXED GUIDE RING 5, then rising vertically and passing through a CIRCULAR OPENING 20 in the tub cover 8. The other side of the GUIDE RING SUPPORT 3 is fastened to the top center of the side frame, thus holding the FIXED GUIDE RING 5 in a fixed position. Each GUIDE RING SUPPORT 3 is constructed of two L-shaped pieces which are joined together with a disconnectable COUPLING 10 in the vertical part above the FLEXIBLE MOISTURE SHIELD 11 and CIRCULAR OPENING 20 in the tub cover 8. This allows the tub cover 8 to be separated from the FIXED GUIDE RING 5 and to be removed from the washing machine, if necessary. The CIRCULAR OPENING 20 in the tub cover 8, where the four GUIDE RING SUPPORTS 3 of the FIXED GUIDE RING 5 pass through, must be sufficiently large to allow enough space for the GUIDE RING SUPPORTS 3 (which remain stationary) when the tub cover 8, tub 2 and basket 4 shift during an unbalanced load. FLEXIBLE MOISTURE SHIELDS 11 are provided and secured to the GUIDE RING SUPPORTS 3 below the COUPLINGS 10 and to the top of the CIRCULAR OPENING 20 in the tub cover 8 to prevent moisture or water to rise above the tub cover 8 during the washing machine operation. To the inside top of the clothes basket are attached six TELESCOPING INDICATORS 6, 60 degrees apart (FIG. 1, 2, 3 and 4). The other end of the TELESCOPING INDICATORS 6 will be in the shape of a C-SHAPED HOOK 14, and will ride around on the inside of the FIXED GUIDE RING 5 (FIG. 1, 2, 3 and 4). Each TELESCOPING INDICATOR 6 (FIG. 2) includes a FIXED TUBE 12 secured to the top of the inner wall of the clothes basket 4 and has an open end distal to the wall of the clothes basket 4. A hollow SLEEVE 13 having an open end is positioned inside the FIXED TUBE 12 and a C-SHAPED HOOK 14 is slidably disposed within the SLEEVE 13 and engages the FIXED GUIDE RING 5. The outer surface of the C-SHAPED HOOK TELESCOPING INDICATOR 6 carries an ANNULAR STOP 15 which is adapted to strike the open end of the SLEEVE 13, and limits the movement of the C-SHAPED HOOK 14 into the SLEEVE 13. The six TELESCOPING INDICATORS 6 will be divided into three pairs. Each pair will have its own color; similarly colored TELESCOPING INDICATORS 6 are to be secured diametrically opposite each other, 180 degrees apart (FIG. 2, 3 and 4). The colors could be red, blue and yellow, and each of the above colored TELESCOPING INDICATORS 6 will have RAISED DOTS 16 (as in Braille), for instance: red TELESCOPING INDICATORS 6 one dot, blue will have two, and yellow three dots. Having RAISED DOTS 16 on the colored TELESCOPING INDICATORS 6 will be very useful to a person who suffers from color blindness, impaired vision or a complete loss of sight. The TELESCOPING INDICATORS 6 can be identified by sight (seeing the color or the RAISED DOTS 16) or by touch (feeling the RAISED DOTS 16), enabling one to balance the load or have the imbalance reduced to an acceptable level.

When the washing machine goes into one of its spin cycles, and the load is unbalanced, the pivot point of the agitator and clothes basket will not be fixed or stationary. The pivot point will move into the direction where the unbalanced load in the clothes basket is located. Since the basket is spinning and is attached via the clutch assembly, transmission, etc. to the platform, this will cause the platform to rotate and if the imbalance is sufficient, to come into contact with the inside of the washing machine frame, resulting in a banging noise and possible movement of the washing machine across the floor. The weight of the unbalanced load will determine the distance the pivot point of the basket and agitator will shift. This distance is equal to the radius of a circle that this pivot point will rotate. When the pivot point shifts, the platform to which all of the forementioned parts are attached, will also shift, including the colored telescoping indicator(s), which are attached to the top inside of the basket. Due to this shift, the C-shaped hook end of the colored telescoping indicators which ride around inside the fixed guide ring will be engaged and pulled out by the fixed guide ring, causing the sleeve to slide out of the fixed tube. Thus the colored indicator(s) will be extended. If the imbalance is sufficient and requires that the washing machine be stopped, one or more colored extended telescoping indicators will show the user where the unbalanced part of the load is. Some of the load must then be repositioned to the opposite side of the basket where the colored indicator of similar color is located. If more than one is extended, the one that is extended most will indicate where the heavier part of the unbalanced load is. If none of the indicators are visibly extended on the washing machine where the back part of the top lid opening is straight, the user can feel underneath the straight part of the opening if any indicators are extended. Then reposition the load as explained above.

After adjusting the load, all the indicators must be recessed or pushed all the way in (FIG. 2 and 4), before restarting the washing machine, so that any further imbalance will be indicated, if the washing machine has to be stopped again. This procedure will be repeated until the imbalance has been reduced to a minimal or tolerable level.

The fixed guide ring assembly with telescoping load imbalance indicators is simple in its construction and should be inexpensive to manufacture and install. It will allow the user of a top loading automatic washing machine to operate it more efficiently when an unbalanced load occurs.

What is claimed is:

1. A clothes washer including a frame, a tub inside the frame, a clothes basket inside the tub, means for rotating said basket including means for permitting the basket to tilt in case of an imbalance in the location of the clothes in said basket, and means in operative relation with said basket and in contact with said basket for providing a visual indication to an operator when said basket deviates from the perpendicular as it rotates in operation of said washer, whereby an operator visually inspects said means for providing a visual indication means and can determine the location of an imbalance in the clothes in the basket and correct the clothes distribution to eliminate the imbalance, said means for providing a visual indication comrpises a ring fixed in position adjacent to said basket and a plurality of slideable members secured to said basket and engaging said ring whereby if the clothes basket deviates from the vertical in a spin operation, one of said slideable members slides to a position which indicates that there is an imbalance whereby an operator can visually detect the imbalance indication and can correct the imbalance.

2. The apparatus defined in claim 1 wherein said means for providing a visual indication comprises a first sleeve secured to said basket, a second sleeve slideably inserted in said first sleeve, and a hook-like member slideably inserted in said second sleeve and having a curved end which engages said ring.

3. The apparatus defined in claim 2 wherein said hook-like member is colored to assist an operator in identifying it.

4. The apparatus defined in claim 2 wherein said hook-like member carries raised members so that a person with visual impairment can identify it and its location.

5. The apparatus defined in claim 1, there being a plurality of said means for providing a visual indication disposed in pairs, with the members of each pair being disposed generally diametrically opposite each other.

6. The apparatus defined in claim 1 wherein said tub includes an apertured top surface having a plurality of holes spaced apart generally on a circle, a rod inserted in each of said holes and secured to said ring to hold said ring in place in a horizontal plane, and each rod being secured to the frame of said washer.

7. The apparatus defined in claim 6 and including a detachable coupling secured to said rod to permit said rod to be disengaged from said frame of said washer.

8. The apparatus defined in claim 6 and including a protective sleeve covering each of said holes to prevent moisture from entering therein.

9. The apparatus defined in claim 1 wherein said ring is disposed horizontally adjacent to said basket.

* * * * *